US006216593B1

(12) United States Patent
Tessler

(10) Patent No.: US 6,216,593 B1
(45) Date of Patent: Apr. 17, 2001

(54) ANIMATION GENERATING APPARATUS AND METHOD

(76) Inventor: Linda Tessler, 22249 NE. 7th St., Redmond, WA (US) 98053

( * ) Notice: Subject to any disclaimer, the term of this patent is extended or adjusted under 35 U.S.C. 154(b) by 0 days.

(21) Appl. No.: 09/383,683

(22) Filed: Aug. 26, 1999

(51) Int. Cl.[7] ..... B41K 1/08

(52) U.S. Cl. ..... 101/373; 101/372; 101/405

(58) Field of Search ..... 101/333, 369, 101/368, 373, 327, 370, 371, 372, 405; 472/72

(56) References Cited

U.S. PATENT DOCUMENTS 3,973,494 * 8/1976 Morrison et al. ..... 101/373
4,611,994 * 9/1986 Glover ..... 434/85
5,462,595 * 10/1995 Im ..... 118/264

* cited by examiner

*Primary Examiner*—John S. Hilten
*Assistant Examiner*—Kevin D. Williams

(57) ABSTRACT

A cartoon generation system is provided including at least one figurine each having at least a pair of members with at least one of the members pivotally coupled to one of the other members. The members of the figurine each have at least one substantially planar face which remains in coplanar relationship with the substantially planar faces of the remaining members.

13 Claims, 2 Drawing Sheets

FIG. 2
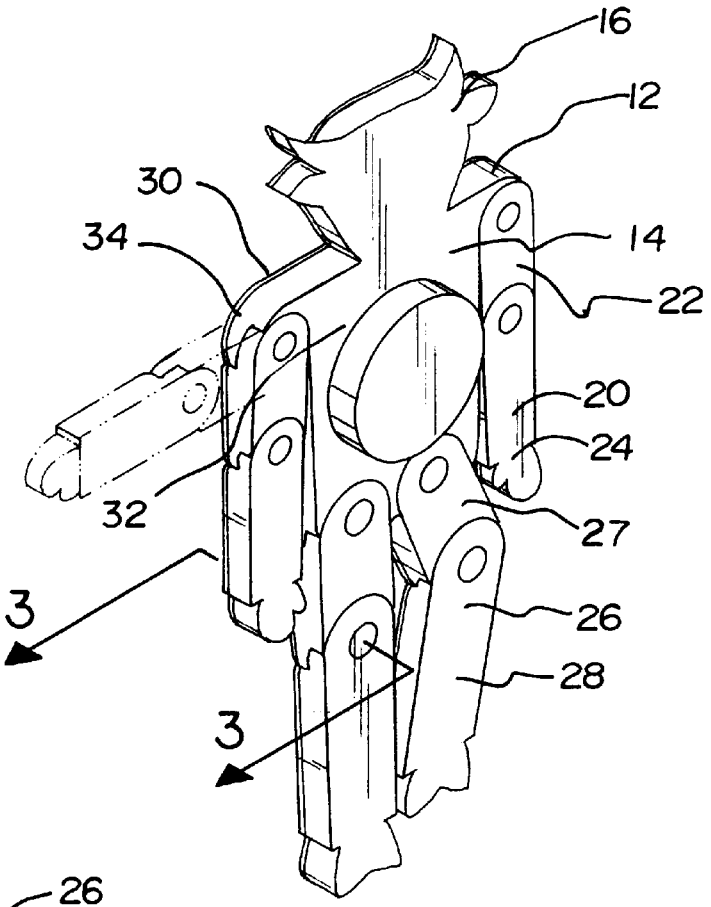
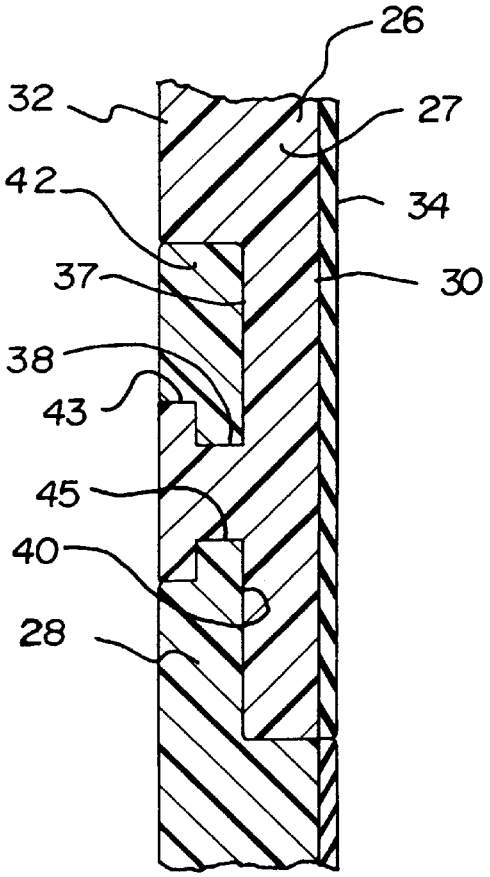
FIG. 3

ANIMATION GENERATING APPARATUS AND METHOD

BACKGROUND OF THE INVENTION

1. Field of the Invention

The present invention relates to stamp assemblies and more particularly pertains to a new animation generating apparatus and method for creating an animation book.

2. Description of the Prior Art

The use of stamp assemblies is known in the prior art. More specifically, stamp assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,579,692; U.S. Pat. No. 5,410,962; U.S. Pat. No. 3,158,096; U.S. Pat. No. 5,178,067; U.S. Pat. No. 4,593,618; and U.S. Pat. No. Des. 317,189.

In these respects, the animation generating apparatus and method according to the present invention substantially departs from the conventional concepts and designs of the prior art, and in so doing provides an apparatus primarily developed for the purpose of creating an animation book.

SUMMARY OF THE INVENTION

In view of the foregoing disadvantages inherent in the known types of stamp assemblies now present in the prior art, the present invention provides a new animation generating apparatus and method construction wherein the same can be utilized for creating an animation book.

The general purpose of the present invention, which will be described subsequently in greater detail, is to provide a new animation generating apparatus and method apparatus and method which has many of the advantages of the stamp assemblies mentioned heretofore and many novel features that result in a new animation generating apparatus and method which is not anticipated, rendered obvious, suggested, or even implied by any of the prior art stamp assemblies, either alone or in any combination thereof.

To attain this, the present invention generally comprises a plurality of figurines each having a torso member, a head member mounted on an upper extent of the torso member, at least one arm member including an inboard portion pivotally coupled to a central extent of the torso member and an outboard portion pivotally coupled to the inboard portion of the arm member, and at least one leg member including an inboard portion pivotally coupled to a lower extent of the torso member and an outboard portion pivotally coupled to the inboard portion of the leg member, each of the members having a first planar face, a second planar face and a periphery formed therebetween, wherein the first planar faces of the members remain in coplanar relationship during pivoting with respect to each other, the first planar face of each of the members having a planar elastomeric pad mounted thereon with the pad having a plurality of ornate grooves formed therein, the second planar face of the torso member having a disk-shaped knob mounted thereon for gripping purposes; a paper pad including a plurality of substantially square flexible sheets of paper each having side edges coupled via a binder for being flipped in a consecutive manner; and an ink pad assembly including a base with a bottom face having a peripheral side wall coupled to a periphery of the bottom face and extending upwardly therefrom for defining an interior compartment for housing an ink pad and a lid hingably coupled to the peripheral side wall of the ink pad assembly for selectively sealing the ink pad within the interior compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new animation generating apparatus and method apparatus and method which has many of the advantages of the stamp assemblies mentioned heretofore and many novel features that result in a new animation generating apparatus and method which is not anticipated, rendered obvious, suggested, or even implied by any of the prior art stamp assemblies, either alone or in any combination thereof.

It is another object of the present invention to provide a new animation generating apparatus and method which may be easily and efficiently manufactured and marketed.

It is a further object of the present invention to provide a new animation generating apparatus and method which is of a durable and reliable construction.

An even further object of the present invention is to provide a new animation generating apparatus and method which is susceptible of a low cost of manufacture with regard to both materials and labor, and which accordingly is then susceptible of low prices of sale to the consuming public, thereby making such animation generating apparatus and method economically available to the buying public.

Still yet another object of the present invention is to provide a new animation generating apparatus and method which provides in the apparatuses and methods of the prior art some of the advantages thereof, while simultaneously overcoming some of the disadvantages normally associated therewith.

Still another object of the present invention is to provide a new animation generating apparatus and method for creating an animation book.

Even still another object of the present invention is to provide a new animation generating apparatus and method that includes at least one figurine each having a torso member, a head member mounted on an upper extent of the torso member, and at least one extremity member pivotally coupled to the torso member. The members of the figurine each have at least one substantially planar face which remains in coplanar relationship with the substantially planar faces of the remaining members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a rear perspective view of one of the figurines of the present invention.

FIG. 3 is a side cross-sectional view of the present invention taken along line 3—3 shown in FIG. 2.

DESCRIPTION OF THE PREFERRED EMBODIMENT

Figure 1:
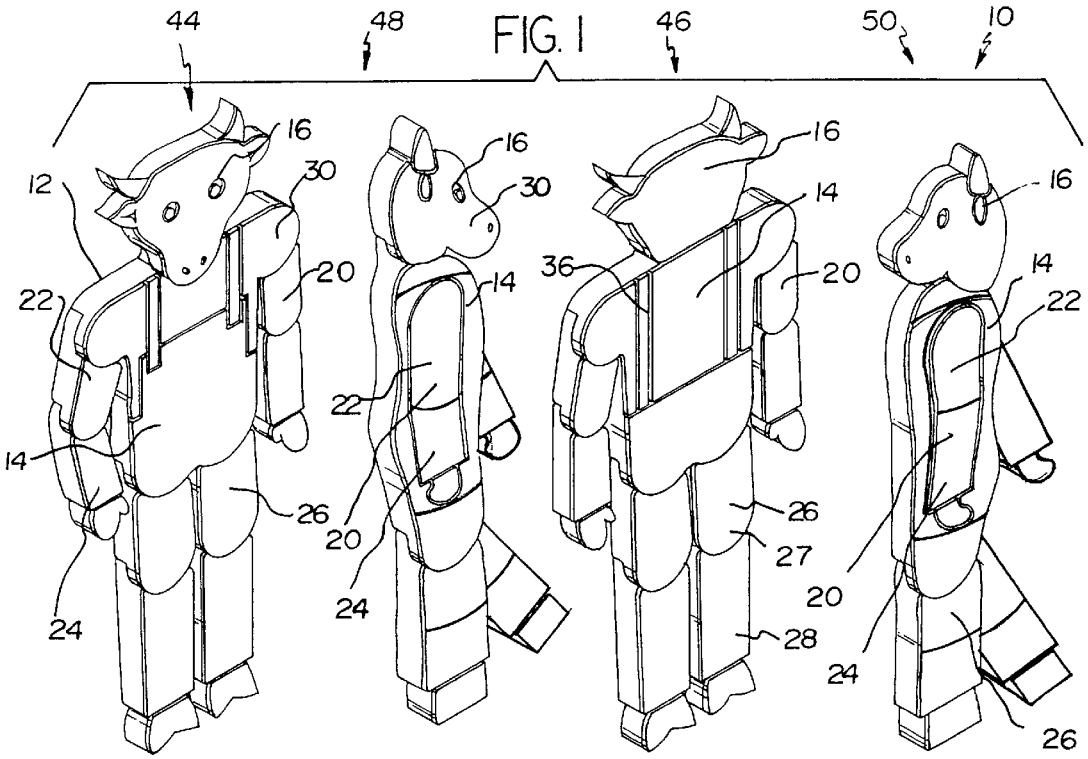
FIG. 1 is an exploded perspective view of a new animation generating apparatus and method according to the present invention.
Figure 4:
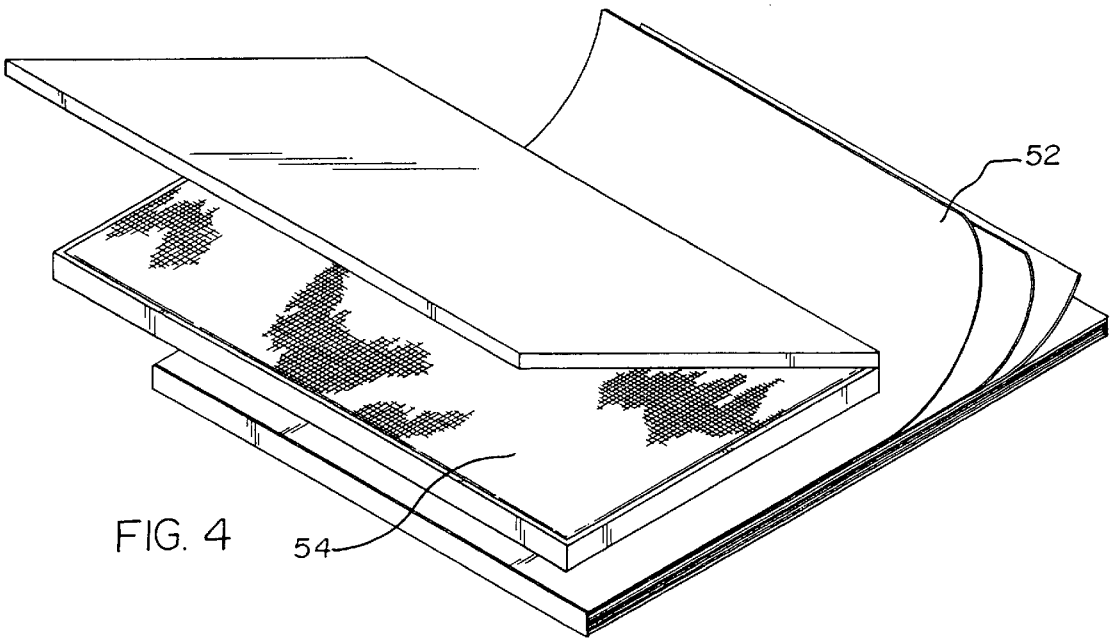
FIG. 4 is a perspective view of the ink pad assembly and the sheets of paper of the present invention.

With reference now to the drawings, and in particular to FIGS. 1 through 4 thereof, a new animation generating apparatus and method embodying the principles and concepts of the present invention and generally designated by the reference numeral 10 will be described.

The present invention, designated as numeral 10, includes a plurality of figurines 12 each having a torso member 14 and a head member 16 mounted on an upper extent 18 of the torso member. As shown in FIG. 1, also included is at least one arm member 20 having an inboard portion 22 pivotally coupled to a central extent of the torso member and an outboard portion 24 pivotally coupled to the inboard portion of the arm member. Associated therewith is at least one leg member 26 including an inboard portion 27 pivotally coupled to a lower extent of the torso member. An outboard portion 28 of the leg member is pivotally coupled to the inboard portion of the leg member. Ideally, each of the members of the figurine is constructed from a rigid plastic.

It should be noted that each of the members has a first planar face 30, a second planar face 32 and a periphery formed therebetween. In use, the first planar faces of the members remain in coplanar relationship during pivoting with respect to each other. The first planar face of each of the members has a planar elastomeric pad 34 mounted thereon with the pad having a plurality of ornate grooves 36 formed therein. The pad is preferably constructed from a material which is more flexible and resilient with respect to the plastic of the rigid figurines. For gripping purposes, the second planar face of the torso member has a disk-shaped knob 39 mounted thereon.

For affording the aforementioned pivotal coupling, each of the inboard portions of the arm and leg members and the torso member of the figurines has a substantially annular recess 37 formed in the associated member (see FIG. 3). Each substantially annular recess 37 defines a protrusion that has a cylindrical rod portion 38 and a flange portion 43 with a surface located at a position level with the second planar face of the associated member. Each of the outboard portions of the arm and leg members has a complementary recess 40 formed in the associated member to define an extension 42. The extension 42 is equipped with an aperture 45 formed therein for rotatably receiving the cylindrical rod portion and flange portion of a respective inboard portion of the arm or leg members or the torso member. As shown in FIG. 2, the recesses each have an arcuate surface for allowing smooth pivoting of the members.

As shown in FIG. 1, the plurality of figurines include a front view figurine 44 with the periphery of each of the members thereof being configured to represent a front view of a character, a rear view figurine 46 with the periphery of each of the members thereof being configured to represent a rear view of a character, a right side view figurine 48 with the periphery of each of the members thereof being configured to represent a right side view of a character, and a left side view figurine 50 with the periphery of each of the members thereof being configured to represent a right side view of a character. The front view figurines preferably have a width twice that of the side view figurines. It should be noted that the side view figurines may be equipped with one or two arms per the desires of the user. It should be noted that the figurine may take on any form such as a cow or any other animated objects.

Next provided is a paper pad 52 including a plurality of substantially square flexible sheets of white paper. Such sheets each have side edges coupled via a binder for being flipped in a consecutive manner.

Finally, an ink pad assembly 54 is provided including a base with a bottom face having a peripheral side wall coupled to a periphery of the bottom face and extending upwardly therefrom. By this structure, an interior compartment is provided for housing an ink pad. A lid is hingably coupled to the peripheral side wall of the ink pad assembly to selectively seal the ink pad within the interior compartment.

The method associated with the present invention will now be set forth. First, ink is applied to the figurine with the ink pad assembly. Thereafter, the figurine is stamped on the sheets of paper while incrementally moving the members of the figurine prior to stamping the figurine on each subsequent sheet of paper in a desired manner. By this method, animation is afforded upon the sheets of paper being flipped.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cartoon generation system comprising, in combination:

a plurality of figurines, each of the plurality of figurines representing a side view of an object, a first one of the figurines representing a front side view of the object, a second one of the figurines representing a back side view of the object, a third one of the figurines representing a left side view of the object, and a fourth one of the figurines representing a right side view of the object;

each figurine having a torso member and a head member mounted on an upper extent of the torso member;

each of the figurines having an arm member pivotally coupled to the torso, the first and second figurines each having a pair of articulated arm members, each articulated arm member including an inboard portion pivotally coupled to a central extent of the torso member and an outboard portion pivotally coupled to the inboard portion of the arm member for permitting pivotal positioning of the outboard extent of the articulated arm member with respect to the inboard extent of the arm member;

each of the figurines having a leg member pivotally coupled to the torso, the first and second figurines each having a pair of articulated leg members, each articulated leg member including an inboard portion pivotally coupled to a lower extent of the torso member and an outboard portion pivotally coupled to the inboard portion of the leg member for permitting pivotal positioning of the outboard extent of the articulated leg member with respect to the inboard extent of the leg member;

each of the members having a first planar face, a second planar face and a periphery formed therebetween, wherein the first planar faces of the members remain in coplanar relationship during pivoting with respect to each other, the first planar face of each of the members having a planar elastomeric pad mounted thereon with the pad having a plurality of grooves formed therein for outlining features on the figurine, the second planar face of the torso member having a disk-shaped knob mounted thereon for gripping purposes;

said members of each of said figurines each having at least one recess formed in the second planar face thereof with the recesses having a cylindrical rod coupled thereto, wherein said members of said figurines each have at least one recess formed in the first planar surface thereof to define an extension of the member with an aperture formed therein for rotatably receiving the cylindrical rod of another one of the members of the figurine;

a paper pad including a plurality of substantially square flexible sheets of paper each having side edges coupled via a binder for being flipped in a consecutive manner; and an ink pad assembly including a base with a bottom face having a peripheral side wall coupled to a periphery of the bottom face and extending upwardly therefrom for defining an interior compartment for housing an ink pad and a lid hingably coupled to the peripheral side wall of the ink pad assembly for selectively sealing the ink pad within the interior compartment.

2. A cartoon generation system comprising:

a plurality of figurines, at least one of the figurines having a pair of members being pivotally coupled together, a first one of the pair of members comprising a head member and a second one of the pair of members comprising a torso member, the members of the figurine each having at least one substantially planar face which remains in coplanar relationship with the substantially planar faces of the other members of the figurine; and at least one extremity member including an inboard portion pivotally coupled to the torso member and an outboard portion pivotally coupled to the inboard portion of the extremity member; the plurality of figurines including a front view figurine with a periphery of each of the members thereof being configured to represent a front view of a character, a rear view figurine with the periphery of each of the members thereof being configured to represent a rear view of a character, a right side view figurine with the periphery of each of the members thereof being configured to represent a right side view of a character, and a left side view figurine with the periphery of each of the members thereof being configured to represent a left side view of a character.

3. The cartoon generation system as set forth in claim 2 wherein the substantially planar faces of the members of the figurine each comprises an elastomeric pad.

4. The cartoon generation system as set forth in claim 2 and further including a paper pad including a plurality of flexible sheets of paper each having side edges coupled for being flipped in a consecutive manner and an ink pad assembly.

5. A cartoon generation system comprising:

a plurality of figurines, each of the plurality of figurines representing a side view of an object, a first one of the figurines representing a front side view of the object, a second one of the figurines representing a back side view of the object, a third one of the figurines representing a left side view of the object, and a fourth one of the figurines representing a right side view of the object;

each figurine having a torso member and a head member mounted on an upper extent of the torso member;

each of the figurines having an arm member pivotally coupled to the torso, the first and second figurines each having a pair of articulated arm members, each articulated arm member including an inboard portion pivotally coupled to a central extent of the torso member and an outboard portion pivotally coupled to the inboard portion of the arm member for permitting pivotal positioning of the outboard extent of the articulated arm member with respect to the inboard extent of the arm member;

each of the figurines having a leg member pivotally coupled to the torso, the first and second figurines each having a pair of articulated leg members, each articulated leg member including an inboard portion pivotally coupled to a lower extent of the torso member and an outboard portion pivotally coupled to the inboard portion of the leg member for permitting pivotal positioning of the outboard extent of the articulated leg member with respect to the inboard extent of the leg member;

each of the members having a substantially planar first face for printing ink applied thereon onto a planar surface, wherein the first faces of the members remain in a substantially coplanar relationship with each other during pivoting of the members with respect to each other.

6. The system of claim 5 additionally comprising a paper pad including a plurality of sheets of paper each having a side edge coupled together by a binder for permitting the sheets to be flipped in a consecutive manner for sequential viewing of the sheets.

7. The system of claim 5 additionally comprising an ink pad assembly.

8. The system of claim 7 wherein the ink pad assembly includes a base with a bottom wall having a peripheral side wall coupled to a periphery of the bottom wall and extending upwardly from the bottom wall for defining an interior compartment, an ink pad situated in the interior compartment, and a lid coupled to the peripheral side wall for selectively enclosing the ink pad in the interior compartment.

9. The system of claim 5 wherein each of the members has a second face and a periphery formed between the first and second faces.eb;normal

10. The system of claim 9 wherein the second face of the torso member has a knob mounted thereon for gripping by a hand of a user.

11. The system of claim 5 wherein the first face of each of the members comprises an elastomeric pad.

12. The system of claim 11 wherein the pad has a plurality of grooves formed therein for outlining features on the figurine.

13. The system of claim 5 wherein the members of each of the figurines each have at least one recess formed in a second face thereof, the recesses having a cylindrical rod coupled thereto, wherein the members of the figurines each have at least one recess formed in the first planar surface thereof to define an extension of the member with an aperture formed therein for rotatably receiving the cylindrical rod of another one of the members of the figurine.

* * * * *